US005915880A

United States Patent [19]

Nordberg

[11] Patent Number: 5,915,880

[45] Date of Patent: Jun. 29, 1999

[54] DRAINAGE APPARATUS

[75] Inventor: Henry T. Nordberg, Oneida, N.Y.

[73] Assignee: Tirecore Limited Partnership, Tinton Falls, N.J.

[21] Appl. No.: 08/844,497

[22] Filed: Apr. 18, 1997

[51] Int. Cl.[6] ..... E01F 5/00; F16L 9/22

[52] U.S. Cl. ..... 405/126; 405/36; 138/155

[58] Field of Search ..... 405/36, 43, 47–49, 405/124, 126; 138/120, 155

[56] References Cited

U.S. PATENT DOCUMENTS

| | | | |
|---|---|---|---|
| 3,928,701 | 12/1975 | Roehner | 405/16 X |
| 4,142,821 | 3/1979 | Doring | 405/16 X |
| 4,248,209 | 2/1981 | Wasserman | 126/620 |
| 4,645,377 | 2/1987 | Vesterby | 405/43 X |
| 4,824,287 | 4/1989 | Tracy | 405/43 X |
| 4,995,759 | 2/1991 | Plowman et al. | 405/43 |
| 5,096,772 | 3/1992 | Snyder | 428/105 |
| 5,172,528 | 12/1992 | Clarke | 52/198 |
| 5,178,489 | 1/1993 | Suhayda | 405/16 X |
| 5,236,756 | 8/1993 | Halliburton | 428/36.8 |
| 5,316,815 | 5/1994 | Tripp | 428/66.6 |
| 5,370,475 | 12/1994 | LeBlanc | 405/16 X |
| 5,372,451 | 12/1994 | Stewart | 404/6 |
| 5,718,166 | 2/1998 | Phillips | 138/155 X |

OTHER PUBLICATIONS

Viessman, Jr. and Hammer, Water Supply and Pollution Control, 5th Ed., Harper Collins College Publishers, pp. 236–237, 1993.

*Primary Examiner*—Tamara Graysay
*Assistant Examiner*—Tara L. Mayo
*Attorney, Agent, or Firm*—Wall Marjama Bilinski & Burr

[57] ABSTRACT

A cylindrical structure suitable for use as a drainage culvert made from the side walls of discarded motor vehicle tire casings. The side wall sections are stacked and bonded in axial alignment so that the concave face of each of the next adjacent side wall faces the convex face of the next adjacent side wall. One end face of the structure is thus concave and the other end face is convex so that the cylindrical structure can be placed in close alignment with the concave end face of one cylinder in close abutting contact with the convex end face of a second cylinder. Wide kerfs are cut in selected side walls between the outer rim of the side wall and the inner rim so that the selected side walls can expand or contract during banding to provide a rather uniform opening in the cylinder. The kerf also allow the cylinders to weep when water is being conducted therethrough.

6 Claims, 4 Drawing Sheets

DRAINAGE APPARATUS

BACKGROUND OF THE INVENTION

This invention relates to disposing of discarded tire casings in a useful and environmentally safe manner.

In U.S. Pat. No. 5,236,756 to Halliburton there is described a method of forming drainage culverts from discarded tire parts. The two side walls of the tire casings are initially separated from the center tread section and the tire beads are then removed from the side wall sections. Mounting holes at specific intervals are formed in each side wall and the side walls are slidably mounted in a face-to-face relationship on a metal frame having parallel rods that align with the holes in the casing. An end plate is placed over the stack and is compressed against a similar end plate welded to the rods. The stack is finally secured in a compressed state by metal gripping devices that are also used to cojoin one culvert section to an adjacent section.

The Haliburton culvert provides a relatively tight conduit for conducting water from one place to another. As explained by Halliburton, tar or the like can be coated over the interior and exterior surfaces of the culvert as well as the exposed surfaces of the metal parts to render the system water tight and protect the metal components against corrosion. Because of the many machining operations required in the construction of the culvert sections and the amount of steel parts utilized in the construction, the cost of each section is relatively high.

Unlike Halliburton, applicant's present invention relates to the use of discarded tire casings in the construction of drainage systems for redistributing water from wet areas to dryer areas where the water can be returned back into the soil. As will be described below, the pipe-like sections of applicants invention are provided with radially disposed passages to permit water to move into and out of the pipe sections at a desired rate.

The present drainage system does not require the use of metal parts in its construction and thus, is not susceptible to corrosion or deterioration when buried in the ground. The drainage sections can be assembled with a minimum amount of manufacturing steps, thereby considerably reducing the cost of the individual sections. The sections can furthermore be laid in the ground with a minimum amount of preparation thereby reducing the cost of installing.

SUMMARY OF THE INVENTION

It is therefore an object of the present invention to utilize discarded tire casings in an environmentally safe and useful manner.

It is a farther object of the present invention to provide a drainage system constructed from discarded tire casings.

It is a still further object of the present invention to provide a cylindrical drainage pipe constructed of discarded tire casings that is capable of effectively metering water into and out of the system.

Another object of the present invention is to provide a drainage pipe that is constructed from the side walls of discarded tire casings that are banded together using non-corrosive banding materials.

Still another object of the present invention is to provide cylindrical drainage pipe sections that are constructed from discarded tire casings in such a manner that the sections can be assembled in axial without the need of special joint fixtures or the like.

These and other objects of the present invention are attained by a system of drainage pipes that are constructed of annular tire side wall sections each having a concave back side and a convex front side. The sections are stacked so that the concave side of one section abuts the convex side of the next adjacent section to create a cylindrical pipe having a concave end face at one end and a convex end face at the other end. A plurality of radially aligned circumferentially spaced cutout pairs are formed in the inner and outer rims of the section forming the concave end face of the pipe. A plurality of bands are around the inside and outside of the stack for banding together the sections. Each band is seated in a cutout pair. Selected oversized or undersized sections are provided with a wide kerf that passes between the outer and inner rims of each selected section whereby the sections can be expanded or compressed circumferentially as the bands are tightened to provide for a uniform opening in the pipe. The kerfs also provide weep holes for allowing water and moisture to pass into and out of said pipe.

BRIEF DESCRIPTION OF THE DRAWINGS

For a better understanding of these and other objects of the present invention, reference will be made to the following detailed description of the invention which is to be read in association with the accompanying drawings, wherein.

DESCRIPTION OF THE INVENTION

Figure 1:
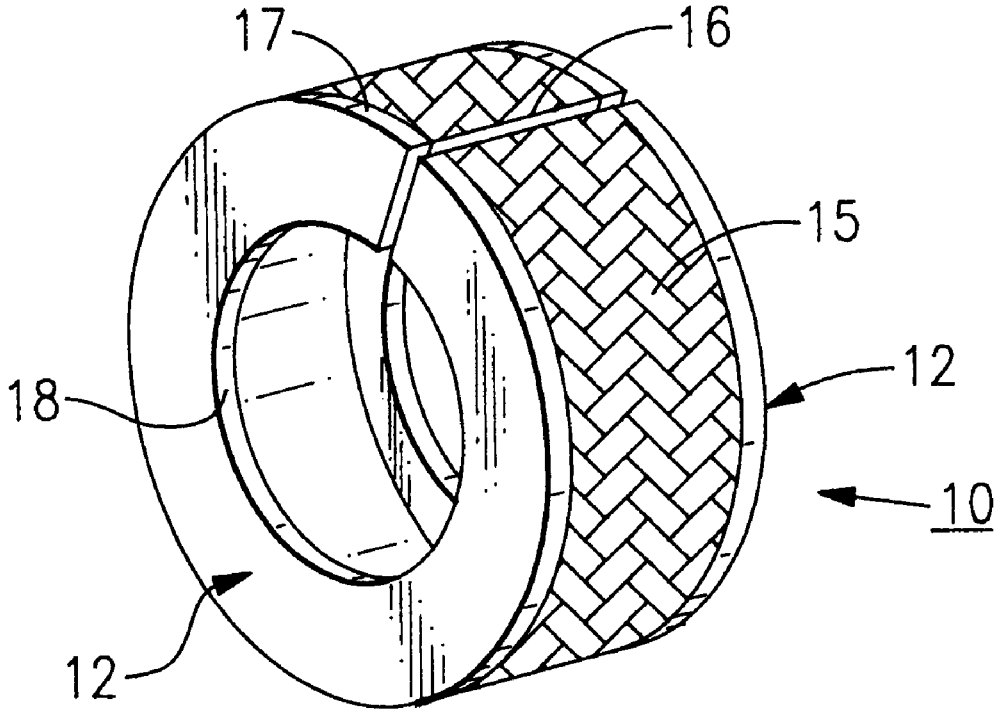
FIG. 1 is a perspective view of a tire casing illustrating the casing divided into sections.
Figure 2:
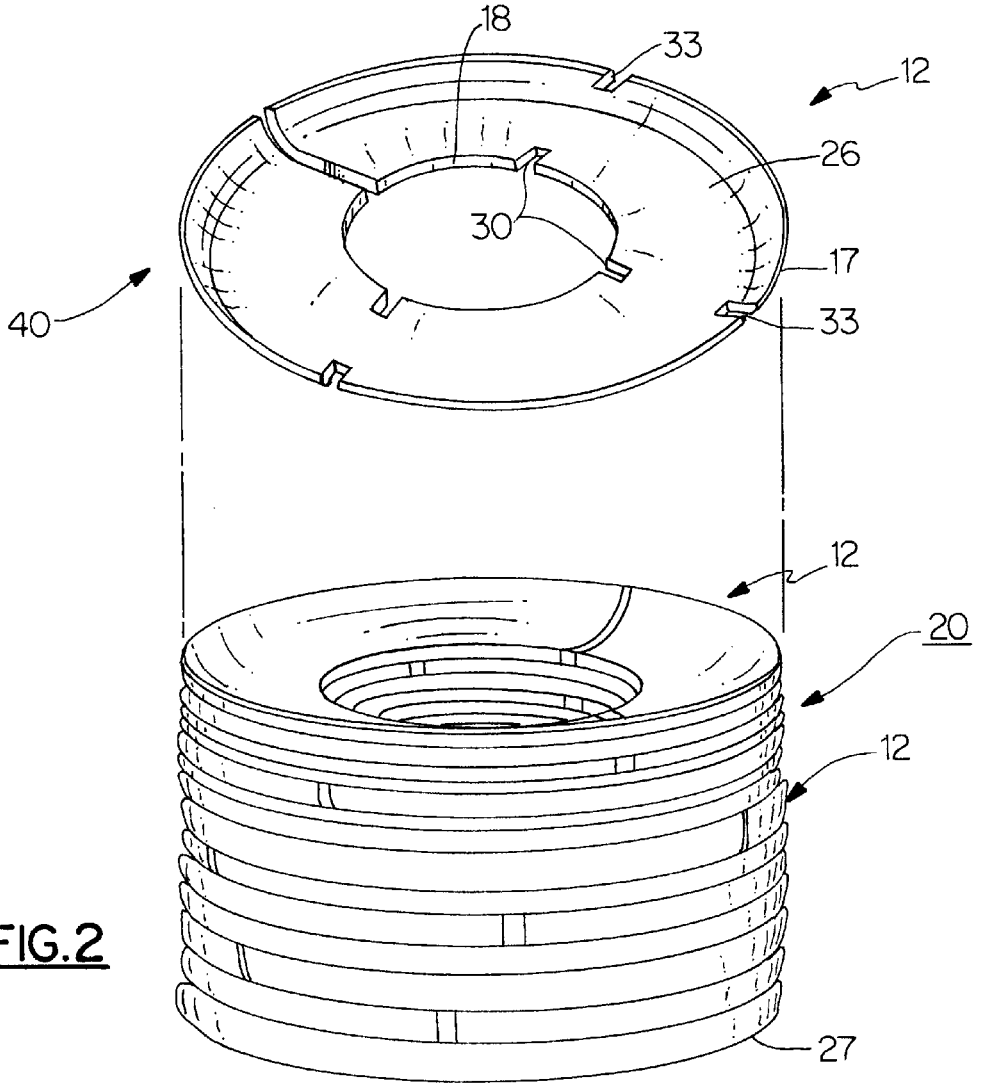
FIG. 2 is a perspective view showing a stack of side wall sections embodying the teachings of the present invention.

Turning initially to FIG. 1, there is shown a discarded motor vehicle tire casing, generally referenced 10, that has been cut into sections. The sections include two end wall sections 12 and a tread section 15. A wide kerf 16 has also been cut axially through the casing that extends radially between the outer rim 17 of the casing and the inner rim 18 thereof. The kerf is sufficiently wide enough to allow the end wall sections to expand and contract circumferentially, the reason for which will be explained in further detail below.

With further reference to FIGS. 2–6 there is illustrated a stack 20 of end wall sections 12 that are placed in axial alignment to form a cylindrical drainage pipe suitable for use as a drainage system. The term drainage pipe as herein used to refer to a pipe that has a certain amount of porosity so that water and moisture can move into and out of the pipe at a desired rate. Accordingly, the pipe can be utilized in drainage systems wherein surface or subsurface water can be collected in a wet region and conducted to a drier region where it is passed back into the ground.

Figure 6:
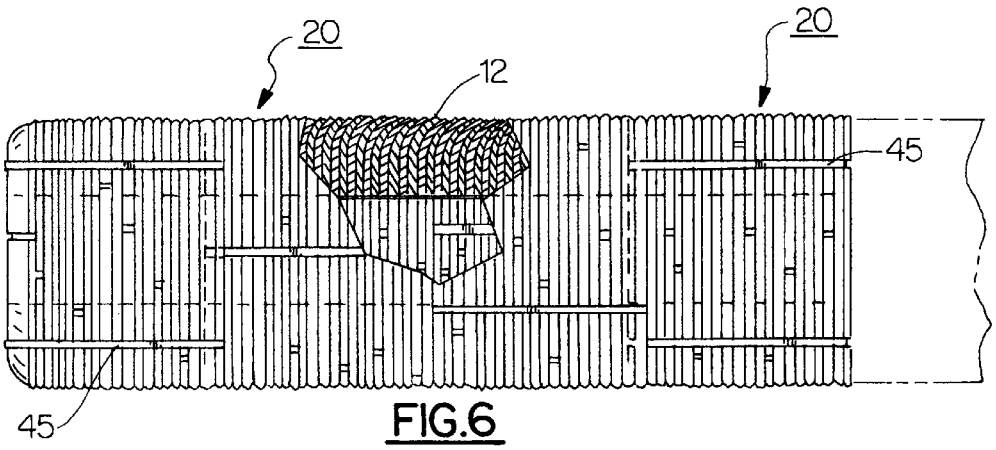
FIG. 6 is a side elevation showing two pipe sections embodying the teachings of the present invention joined together in axial alignment.
Figure 4:
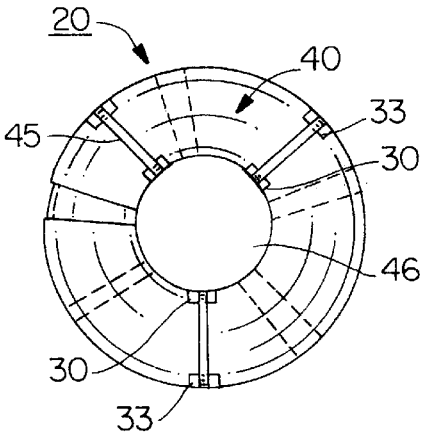
FIG. 4 is an end view showing one end of the banded pipe seating illustrated in FIG. 3.
Figure 5:
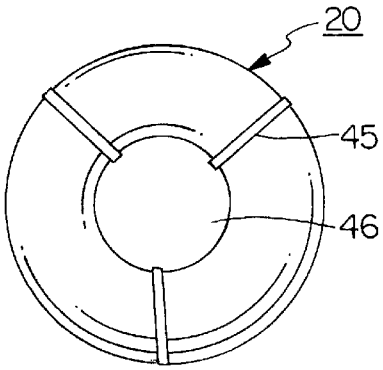
FIG. 5 is a further end view showing the opposite end of the pipe illustrated in FIG. 3.

The individual side wall sections 12 that are cut from a casing each contain a convex side and an opposing concave side. The sections are stacked in axial alignment so that the convex side of each section is placed in abutting contact with the concave side of the next adjacent section in the stack. The stack thus takes the general shape of the end wall sections in that one end face 26 (FIG. 1) of the stack has a concave shape while the opposite end face 27 has a convex shape. Accordingly, as shown in FIG. 6, the individual pipes can be placed in axial alignment with the concave end face of one pipe fitted into the concave end face of an adjacent pipe. Once covered with soil, the pipe sections will remain in alignment indefinitely.

The last tire section 40 in the stack at the concave end face is provided with a plurality of radially disposed aligned cutout pairs. Each pair includes a first cutout 30 formed in inner rim 18 of the section and a second cutout 33 formed in the outer rim 17. Preferably, at least three cutout pairs are formed in casing 40. Each cutout pair is formed to a depth such that the area of the side wall section separating the two cutouts is relatively flat.

The side wall sections are held together by means of bands 45. One end of each band is passed through the central opening 46 of the stack and is seated within one of the cutout pairs. The end is then brought back around the outside of the stack and joined to the other end of the band to form an enclosing loop for holding the end wall sections together. The two ends are joined together to draw the encircled tire sections into close abutting relationship. Sufficient pressure is exerted upon the side wall sections by the three bands to either expand or contract various sections so that the size of the opening passing through the stack is fairly uniform.

In practice, a kerf might be formed in only selected oversized or undersized side wall sections while those side wall sections having a desired hole size need not be kerfed. For example, side wall sections cut from 15" tire casings can remain unkerfed while those cut from 16" and 13" tire casings can be provided with a wide kerf which is preferably 1" wide or greater. As the bands are tightened in assembly, the sections with the smaller opening are expanded circumferentially while the sections with the larger openings are contracted circumferentially. A the same time, the cutouts in the end section 40 allow the bands to exert pressure only on the flat portion of the end face so that the individual sections that are being drawn together in face-to-face relationship do not become distorted and thus lose their original arcuate shape. As a result, the pipe sections 20 each have a convex contour at one end and a concave contour at the other end. The pipe sections can thus be placed concave end face to convex end face to provide a relatively secure joint without the need of special joining fixtures or the like.

The pressure exerted by the bands upon the tire sections is high enough to hold the sections in axial alignment, however, it is not so high as to tightly compact the sections in leak tight contact against each other. As a result, water can find its way into and out of the pipe sections between the end wall and through the kerfs.

Figure 8:
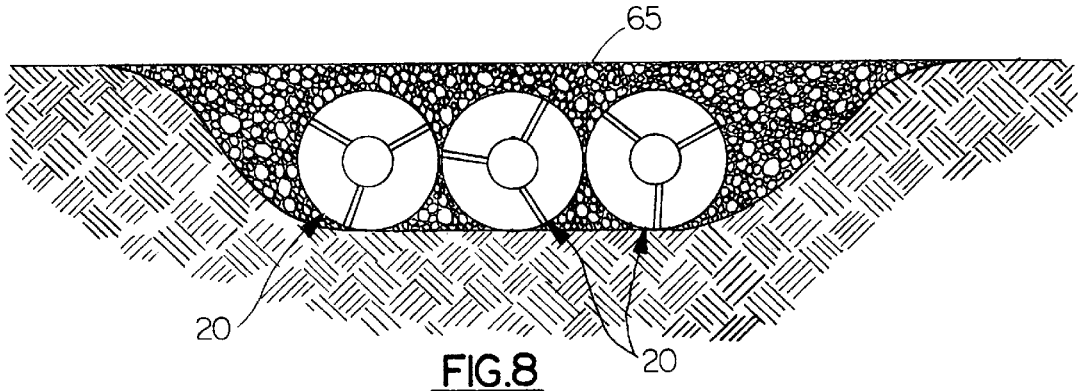
FIG. 8 is an end view in section showing a plurality of pipe sections embodying the present invention laid side by side to provide drainage system beneath a roadway.

Turning now to FIG. 8, there is illustrated a drainage system embodying the teachings of the present invention that extends beneath a roadway 65. In this application, a plurality of pipe sections 20 are laid side-by-side in parallel alignment to increase the load bearing capacity of the system. Because of the resilient nature of the pipe sections, the system can be deflected under heavy loads without deleterious effects. Although three parallel pipes are shown laid side to side in this embodiment, it should be obvious that the number of pipes utilized can vary in relation to the particular load bearing applications.

Figure 7:
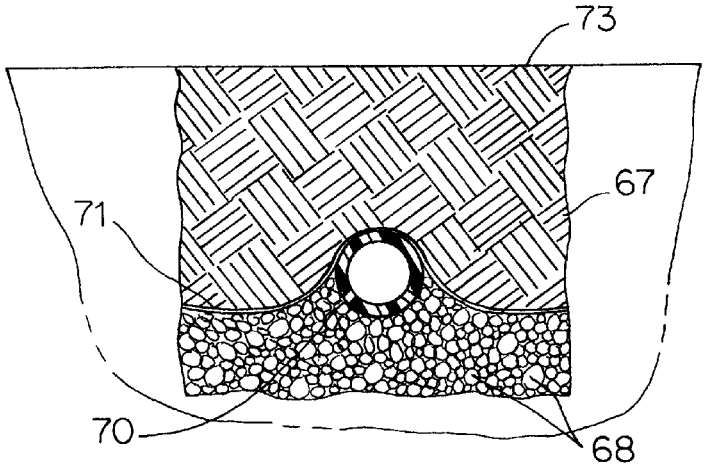
FIG.7 Prior Art
FIG. 7 is an end view in section showing a prior art drainage pipe installation.
Figure 3:
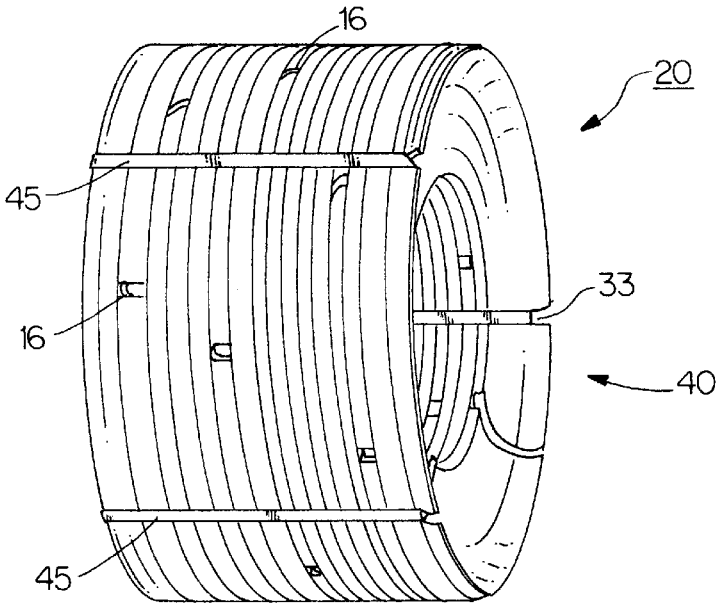
FIG. 3 is a side elevation in perspective showing the stack illustrated in FIG. 1 banded to form a cylindrical drainage pipe.

In many typical drainage systems, such as that shown in FIG. 7, a trench 67 is dug to a desired depth and a rather thick gravel bed 68, is prepared in the bottom of the trench. Perforated piping 70 is then laid in the prepared bed and covered with tar paper 71 or the like to prevent soil from entering the piping. Finally, the trench is filled with soil, 73 to complete the installation. As illustrated in FIG. 8, drainage systems utilizing pipe sections embodying the teachings of the present invention do not require any special preparation. The pipe section can simply be laid end to end in the trench and then simply covered with soil to complete the insulation.

Figure 9:
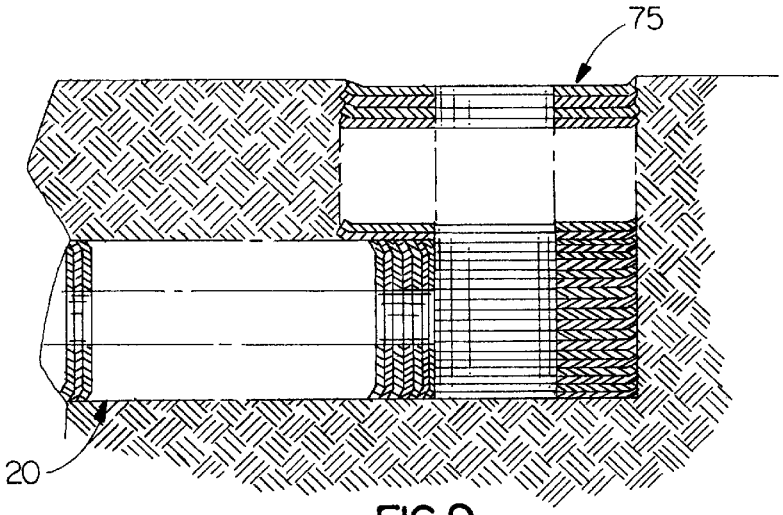
FIG. 9 is a side view in section showing a cistern constructed of pipe sections embodying the present invention.

FIG. 9 depicts a cistern 75 constructed of large diameter side wall sections prepared from truck tires or the like. The side wall sections again are bonded together as explained above and the bonded assembly is placed vertically in the ground so that it can collect and temporarily hold a quantity of water. An opening is formed at the bottom of the cistern into which a drainage pipe section 20 is inserted to place the opening in the drainage pipe in communication with the opening in the cistern. Here again, once the system has been completed, it is simply covered with soil.

Figure 10:
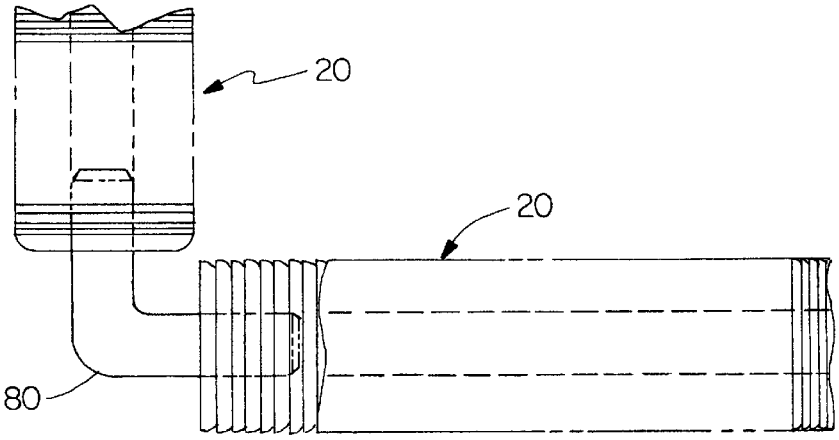
FIG. 10 is a top view showing two pipe sections embodying the present invention being joined at a bend by an elbow.

FIG. 10 illustrates a drainage system that is forced to make a right angle turn. In most drainage applications utilizing drainage pipes embodying the present invention, turns or bends in the drainage lines can be simply accommodated by placing two pipe sections end to end at the desired angle and the bend area between the pipe sections simply filled with gravel or the like. Water issuing from one pipe section thus will course naturally and freely through the gravel bed into the next section. Alternatively, a plastic bend section 80 may be inserted into the adjacent ends of the pipe sections at the bend to provide for a more positive connection. Although a 90° bend is illustrated in FIG. 10, the angle of bend can be varied depending upon the system's needs.

While this invention has been explained with reference to the structure disclosed herein, it is not confined to the details set forth and this invention is intended to cover any modifications and changes as may come within the scope of the following claims:

What is claimed is:

1. A drainage system that includes:

at least two drainage pipes mounted in axial alignment each of said drainage pipes containing a plurality of annular shaped sections cut from discarded tire casings, each section further containing a convex front face and a concave back face, said sections being stacked so that the concave face of one section abuts the convex face of an adjacent section wherein each pipe has one concave end and one convex end said convex end of one pipe being inserted into the concave end of the other pipe, at least one band looped about the center opening and outside periphery of each drainage pipe to apply sufficient pressure upon the pipe to hold the sections in axial alignment and each pipe having selected sections, each of which contains a wide kerf therein that extends radially through the outer periphery of the casing and the center opening therein whereby the selected section can be expanded and contracted circumferentially.

2. The drainage system of claim 1 that further includes at least two drainage pipes angularly aligned with each other and a hollow bend connector inserted in the adjacent openings of each of said angularly aligned pipes.

3. The drainage system of claim 1 that further includes a third drainage pipe mounted vertically to form a cistern that communicates with one of said other drainage pipes.

4. The drainage system of claim 1 wherein said bands are formed of plastic.

5. An article of manufacture that includes a plurality of annular sections cut from discarded tire casings of varying diameters so that each section has a convex outer face and a concave inner face, selected annular sections further containing a wide radial kerf that passes through the selected sections between the sections outer periphery and center opening whereby the selected sections can be expanded or contracted circumferentially to bring all of the sections to approximately the same diameter, said sections being stacked one inside the other so that the outer face of one section abuts the inner face of the next adjacent section said selected sections being expanded and contracted circumferentially within a stack to form a cylindrical member having a uniform outside diameter.

6. The article of manufacture of claim 5 that further includes banding means that loops around the outer periphery and center member to hold the sections in abutting face-to-face relationship.

* * * * *